United States Patent [19]

Mann

[11] 4,407,080

[45] * Oct. 4, 1983

[54] PIVOTALLY MOUNTED RIPPING TEETH ASSEMBLY ON DOZER BLADE

[76] Inventor: Donald B. Mann, 8811 131st Ave. Northeast, Lake Stevens, Wash. 98258

[ * ] Notice: The portion of the term of this patent subsequent to Dec. 30, 1997 has been disclaimed.

[21] Appl. No.: 279,549

[22] Filed: Jul. 1, 1981

Related U.S. Application Data

[63] Continuation-in-part of Ser. No. 163,981, Jun. 30, 1980, abandoned, which is a continuation-in-part of Ser. No. 933,075, Aug. 11, 1978, Pat. No. 4,241,525.

[51] Int. Cl.[3] ..... E02F 3/76

[52] U.S. Cl. ..... 37/117.5; 37/DIG. 3; 414/912

[58] Field of Search ..... 37/117.4, 2 R, DIG. 3, 37/DIG. 12, 118 R, 141 R; 414/685, 912; 172/815, 701.1

[56] References Cited

U.S. PATENT DOCUMENTS

| | | | |
|---|---|---|---|
| 2,262,415 | 11/1941 | Williams et al. | 37/DIG. 3 |
| 2,674,818 | 4/1954 | Carnes | 37/2 R X |
| 2,852,875 | 9/1958 | Bierwith et al. | 37/2 R X |
| 2,950,551 | 8/1960 | Pesce | 37/2 R |
| 3,097,439 | 7/1963 | Calkin | 37/117.5 |
| 3,195,247 | 7/1965 | Grimes | 37/2 R |
| 3,274,710 | 9/1966 | Wright | 37/2 R |
| 3,478,449 | 11/1969 | Baker | 37/117.5 |
| 3,595,416 | 7/1971 | Perrotti | 37/117.5 X |
| 3,975,844 | 8/1976 | Olson | 37/117.5 |
| 4,241,525 | 12/1980 | Mann | 37/117.5 |

*Primary Examiner*—E. H. Eickholt

*Attorney, Agent, or Firm*—Seed, Berry, Vernon & Baynham

[57] ABSTRACT

This invention is an attachment to heavy equipment blades and has a set of ripping teeth projecting downwardly from a pivoting support frame. The frame ordinarily extends downwardly from the pivotal hanger along the front of the blade, with the teeth projecting beyond the lower edge of the blade. As the vehicle, such as a bulldozer, moves forward, the teeth rip, as would teeth which were rigidly secured to the blade. However, as the vehicle moves backward, the teeth and frames swing forward in a floating motion, preventing the teeth from fracturing while allowing the blade to scrape. In a preferred embodiment, the frame includes two end members, each having an ear which curves rearwardly toward the blade. Each bracket releasably receives a forwardly projecting hanger mounted on the upper surface of the blade. The hanger and brackets contain aligned apertures through which a pin is releasably inserted to secure the frame to the blade. With gussets, the frame may be wider than the blade.

8 Claims, 12 Drawing Figures

FIG. 3
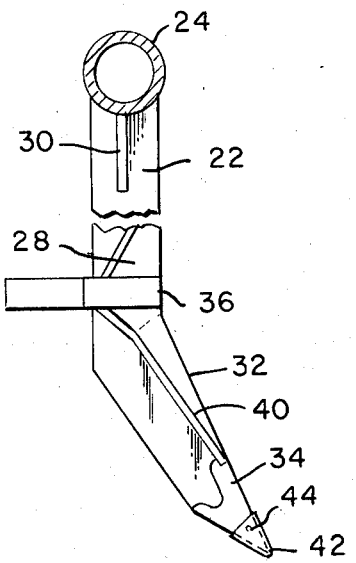
FIG. 4
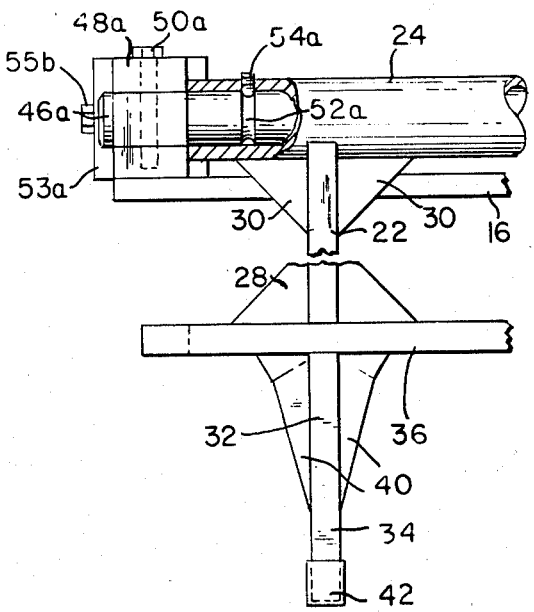
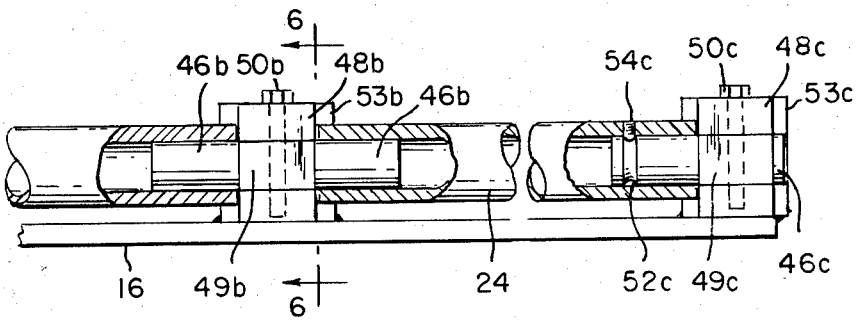
FIG. 5
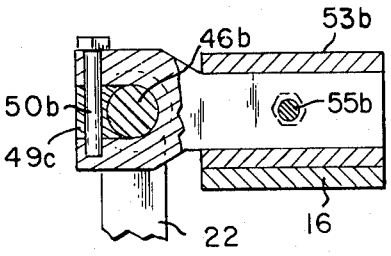
FIG. 6

PIVOTALLY MOUNTED RIPPING TEETH ASSEMBLY ON DOZER BLADE

CROSS-REFERENCE TO RELATED APPLICATION

This application is a continuation-in-part of application Ser. No. 163,981, filed June 30, 1980, now abandoned. Ser. No. 163,981 is, in turn, a continuation-in-part of application Ser. No. 933,075, filed Aug. 11, 1978, now U.S. Pat. No. 4,241,525.

TECHNICAL FIELD

This invention relates to attachments for blades of heavy equipment, such as bulldozers, front-end loaders, skidders, and the like. More particularly, this invention relates to a set of ripping teeth which are pivotally secured to a blade used on heavy equipment, such as a bulldozer.

BACKGROUND ART

Bulldozers having a planar, vertically movable blade secured to their forward ends are commonly used in a variety of applications, including (1) ripping, in which a layer of rigid surfacing material is removed from an area, and (2) grading, in which the lower edge of the blade is scraped along a surface. To rip, teeth are used to dig the blade into the surfacing material. Although ripping teeth may be integrally formed with the lower edge of the blade, individual teeth ordinarily are bolted to the lower edge of the blade. These teeth are removable for the scraping operation and are replaceable when broken. Although these teeth have generally proven somewhat satisfactory for a ripping operation, they suffer from a number of serious shortcomings. The principal disadvantage of bulldozer blades having conventional ripping teeth is the relatively large amount of time required to convert from a ripping or brush blade to a scraping blade. During a ripping operation, after the surfacing material has been broken into pieces, the broken pieces must be removed from a surface and the surface leveled. When using conventional ripping teeth, either the teeth must be removed from the blade, a separate grading blade attached to the bulldozer, or a second bulldozer used to grade.

Another problem associated with conventional ripping teeth is their inability to withstand rearward forces without fracturing. The ripping teeth generally project forwardly and downwardly from the lower edge of the bulldozer blade and are thus extremely sturdy in receiving forces from in front of the blade (since these forces act along the axis of the teeth). However, forces imparted to the teeth from a rearward direction, such as when the bulldozer is moving in a reverse direction with the blade down, produce a force transverse to the longitudinal axis of the teeth, which could easily fracture the teeth, thereby necessitating time-consuming and expensive replacement.

In summary, although conventional ripping teeth are generally satisfactory, they require an excessive period of time to convert from a ripping or brush blade to a scraping blade. Also, their design makes them prone to fracture by rearward forces.

Structures devised for pivotally securing a plurality of elongated members (teeth) to a bulldozer blade are illustrated in U.S. Pat. Nos. 2,132,261; 2,262,415; 3,097,439; and 3,595,416. These devices do not easily and quickly convert a conventional blade into a ripping blade. These devices are either too heavy for optimal efficiency or too weak to withstand typically imposed loads. Additionally, these devices lack features which are essential for achieving various advantageous functions. For example, none of the prior art structures includes means for positioning the teeth so that they will not interfere with the use of the blade in grading. Furthermore, some structures, such as that disclosed in U.S. Pat. No. 2,262,415, employ teeth-mounting structures for the teeth which either interfere with use of the blade or are likely to be damaged when the teeth are removed from the blade.

DISCLOSURE OF THE INVENTION

It is an object of this invention to provide a structure for mounting a set of ripping teeth to a blade which allows the blade to be easily and quickly converted between a ripping blade and a scraping blade.

It is a second object to provide a mounting structure which allows a set of ripping teeth to be added to virtually any size and shape blade.

It is a third object to provide a mounting structure for a set of ripping teeth which does not interfere with the use of the blade and is not likely to be damaged when the teeth are removed from the blade.

It is a fourth object to provide a set of pivotally mounted ripping teeth which may be locked into an upwardly projecting position when the teeth are not to be used.

It is a fifth object to provide a lightweight attachment to allow multipurpose use of small and medium sized heavy equipment, such as bulldozers, front-end loaders, skidders, and the like.

These and other objects are accomplished by a set of ripping teeth projecting from an integrally formed frame which is pivotally secured to the upper edge of the blade along a transverse horizontal axis. In one embodiment, the frame is formed by two separable sections, each section terminating in a tubular mounting sleeve. Mounting pins project from the outer ends of the mounting sleeves, and a mounting shaft extends between the inner ends of the mounting sleeves. The mounting pins and shaft are secured to hangers which are releasably supported by brackets mounted on the blade along the upper edge thereof. During the ripping operation, the teeth project downwardly beyond the lower edge of the blade so that the teeth dig into the under surface when the vehicle, such as a bulldozer, moves forward. The frame is braced against transverse forces by guides projecting rearwardly from the sides of the frame along the sides of the blade. The teeth may be placed in an undeployed position by pivoting the frame upwardly where it is secured in place by a locking hook removably secured to the upper rear face of the blade and extending around a frame member.

In a second embodiment, the frame includes two side members, each having an upper end which terminates in a bracket. The brackets curve rearwardly to receive respective forwardly projecting hangers which are secured to the upper surface of the blade. The rearward curvature of the brackets reduces the necessary forward projection of the hanger, thereby minimizing the lever arm of the hanger and increasing its ability to withstand transverse forces. The brackets are easily releasable from the hangers to allow removal of the teeth assembly from the blade. The side members are preferably integrally formed with the end teeth to maximize the strength of the frame. A rise extension may project upwardly from the upper edge of the rake assembly between the hangers to prevent objects from being thrown over the upper edge of the blade.

In a third embodiment, the frame extends outwardly beyond the sides of the blade to which it is attachable. The hangers are placed above the first inside strut of the frame (or elsewhere if structurally sound), and gussets of plate metal contact the sides of the blade to support the extended frame against longitudinal and transverse stresses. Thus, a widemounted rake is easily attachable to a standard-width blade on heavy equipment, such as bulldozers, front-end loaders, skidders, or the like.

BRIEF DESCRIPTION OF THE DRAWINGS

FIG. 3 is a cross-sectional view taken along the line 3—3 of FIG. 2.

FIG. 4 is a front elevational view of a portion of the assembly of FIG. 1 partially broken away.

FIG. 5 is a partial cross-sectional view illustrating the manner in which the tubular support sleeve is pivotally secured to the transverse support shaft.

FIG. 6 is a cross-sectional view taken along the line 6—6 of FIG. 5.

BEST MODE FOR CARRYING OUT THE INVENTION

Figure 1:
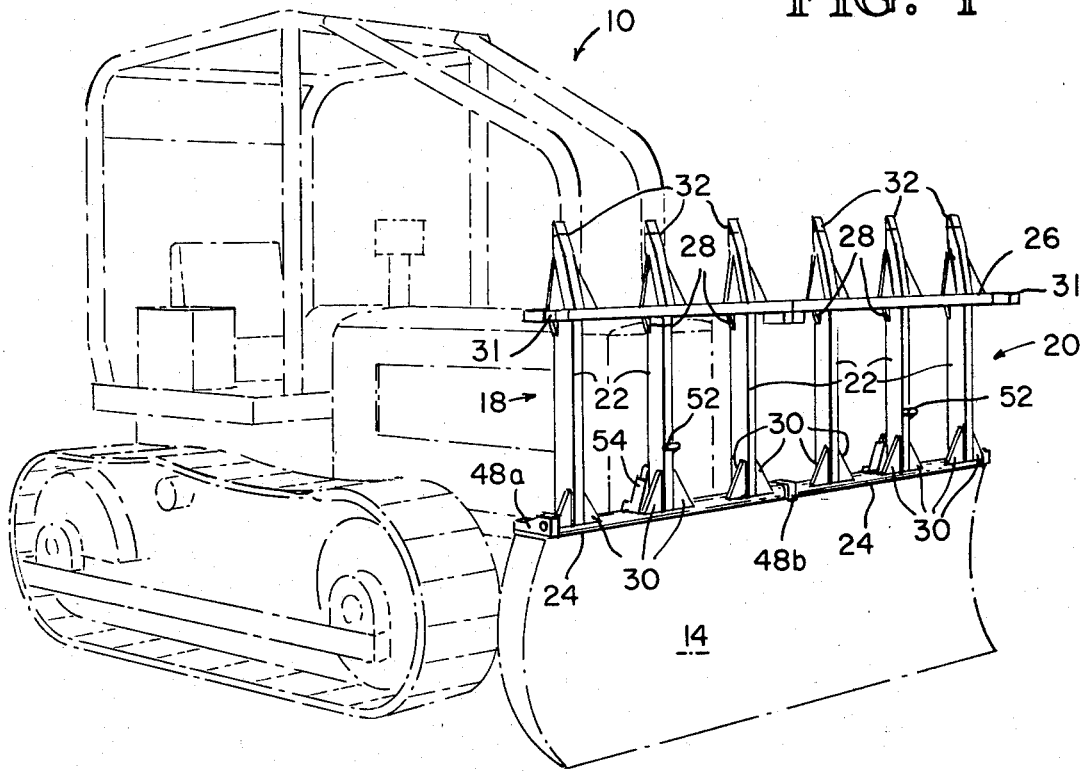
FIG. 1 is an isometric view of one embodiment of the assembly mounted on a bulldozer blade in an undeployed position.
Figure 2:
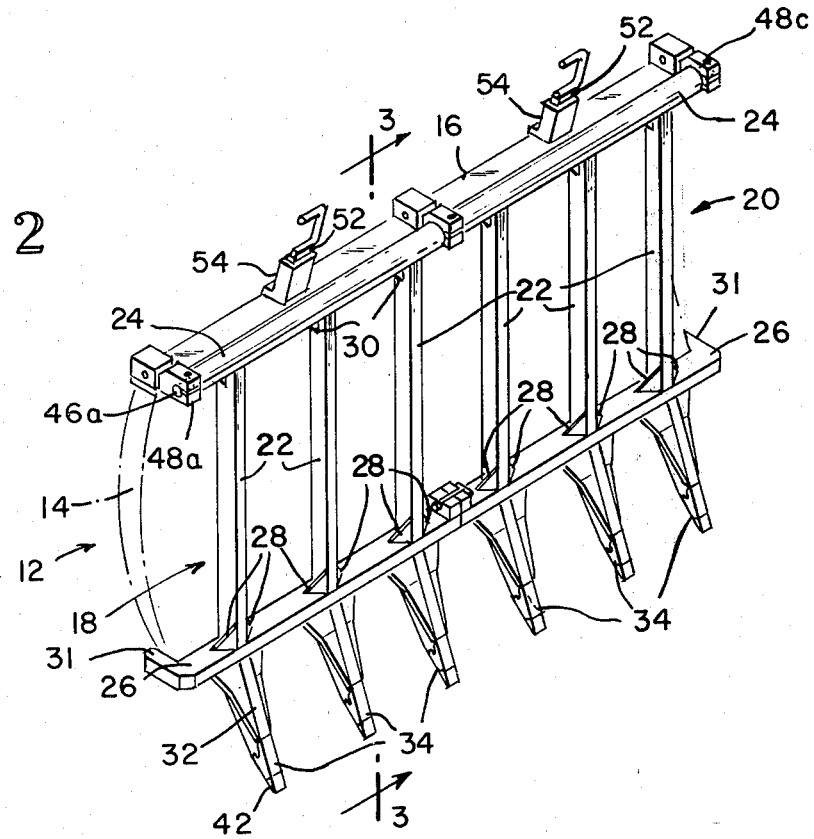
FIG. 2 is an isometric view of the assembly of FIG. 1.

One embodiment of the ripping teeth assembly, as illustrated in FIGS. 1 and 2, is installed on a conventional bulldozer 10. The bulldozer 10 includes a vertically movable blade 12 having a curved front surface 14 and a planar top edge 16. The ripping teeth assembly includes a pair of frames 18,20, each frame including a plurality of rectangular braces 22 extending between tubular mounting sleeves 24 and a rectangular bracing bar 26. Triangular gussets 28 (FIG. 2) are fastened between the braces 22 and the bar 26 to strengthen the frames 18,20. The gussets 28 are angled rearwardly to deflect dirt and debris. Similarly, triangular gussets 30 (FIG. 1) are fastened between the braces 22 and the mounting sleeves 24.

Transverse movement of the frames 18,20 is restricted by guides 31 projecting rearwardly from the bar 26 along the sides of the blade 12.

The braces 22 extend beyond the bar 26 to form teeth 32. As best illustrated in FIGS. 3 and 4, the teeth 32 have a rectangular cross-section and terminate in shanks 34 welded onto the teeth 32. Generally triangular gussets 40 are mounted on opposite sides of the teeth 32 between the teeth 32 and bar 26 to provide lateral strength to the teeth 32. A wear-resistant tip 42 fits over the end of the shank 34 and is secured in place by a transverse pin 44. The bars 26 of the frames 18,20 are connected to each other by a locking bolt 45 received by lugs 47 at the inner ends of the bars 26.

As illustrated in FIGS. 1 and 2, pins 46 projecting from the ends of the support sleeves are received by hangers 48 which are welded along the upper edge 16 of the bulldozer blade 12. As best illustrated in FIGS. 4, 5 and 6, the support pins 46 are loosely received in their respective hangers 48 and are retained in place by retaining members 51 and locking pins 50. The hangers 48 are received by brackets 53 which are welded to the blade 12. The hangers 48 are retained in position by bolts 55 extending through the hangers 48 brackets 53. The support pins 46 are inserted into the sleeves 24, with a circumferential groove 52 formed on the pin 46 aligned with a set screw 54 threaded into a bore in the sleeve 24. As illustrated in FIG. 5, the support structure at the other end of the frame 20 is identical to the support structure for the end of frame 18, illustrated in FIG. 4. The center support for the frames 18,20 is substantially similar except that the shaft **46*b* projects transversely from both sides of the hanger 48*b* and set screws are not used. When the set screws 54 are torqued against the pins 46 in the grooves 52, the pins 46 are rigidly secured to the frames 18,20 so that they rotate within the hangers 48 and are held in place by the retaining members 51 and pins 50** when the ripping teeth assembly is moved between deployed and undeployed positions, as will be explained.

A preferred assembly mounted on a bulldozer 10, for example, is illustrated in its undeployed position in FIG. 1. In its undeployed position, the frames 18,20 are rotated in the hangers 48 to a substantially vertical position and are retained in place by hooks 52 having a hooked portion extending around a brace 22 and a shank portion received by a sleeve 54.

In its deployed position, the assembly is rotated downwardly so that the frames 18,20 contact the front surface 14 of the blade 12 near the lower edge of the blade 12. As the bulldozer 10 moves forward with the blade 12 lowered, the teeth 32 are highly effective in digging into a surface material. Since the forces on the teeth 32 are received from the front, the positions of the frames 18,20 remain fixed by the side guides 31 and the position of the blade 12 so that the teeth 32 act as if they are rigidly secured to the lower edge of the blade 12. However, when the bulldozer 10 moves rearwardly with the blade 12 in a lowered position, the forces are imparted to the teeth 32 from the rear, causing the frames 18,20 to swing forwardly with respect to the blade 12 and to float over the surface of the ground so that these rearward forces are incapable of fracturing the teeth 32 or shanks 34. Dirt and debris may be cleaned from the teeth by moving the bulldozer 10 rearwardly while raising and lowering the blade.

Figure 7:
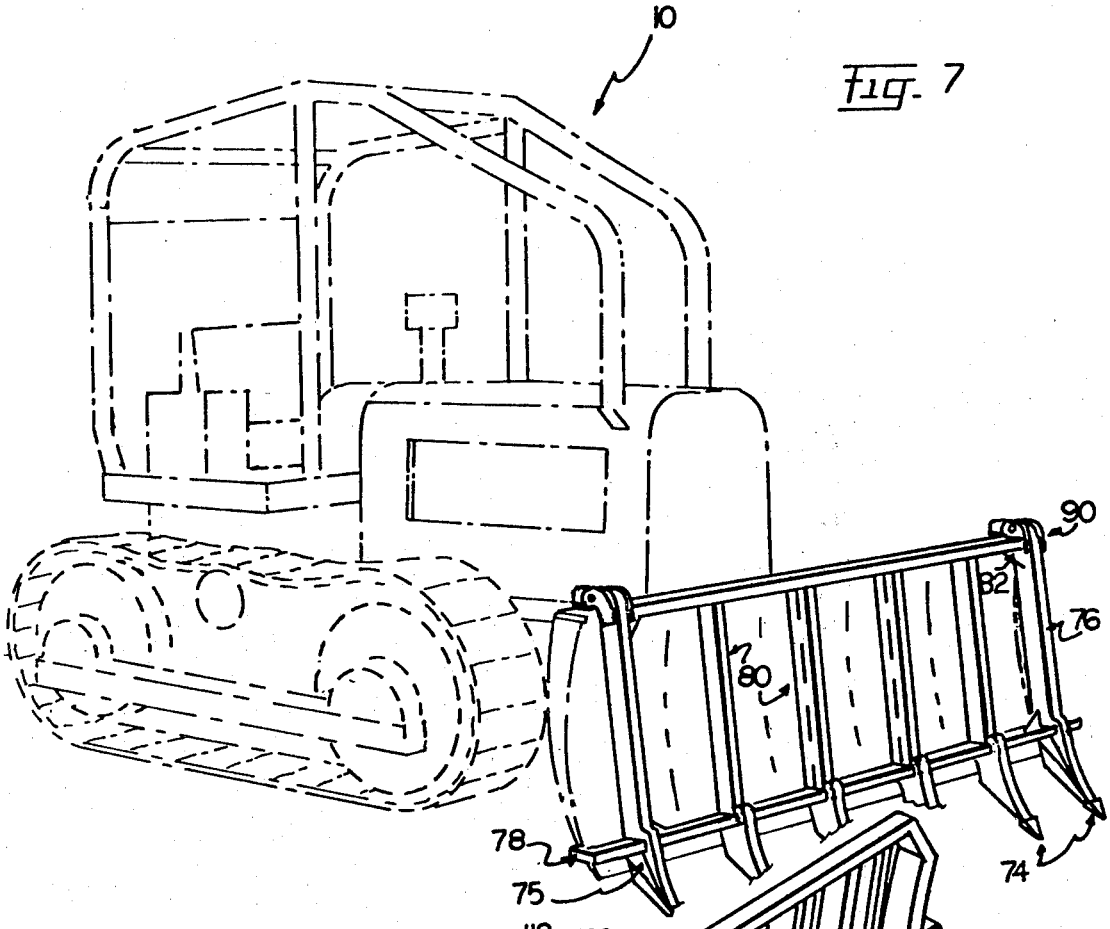
FIG. 7 is an isometric view of another embodiment of the assembly mounted on a bulldozer blade.
Figure 8:
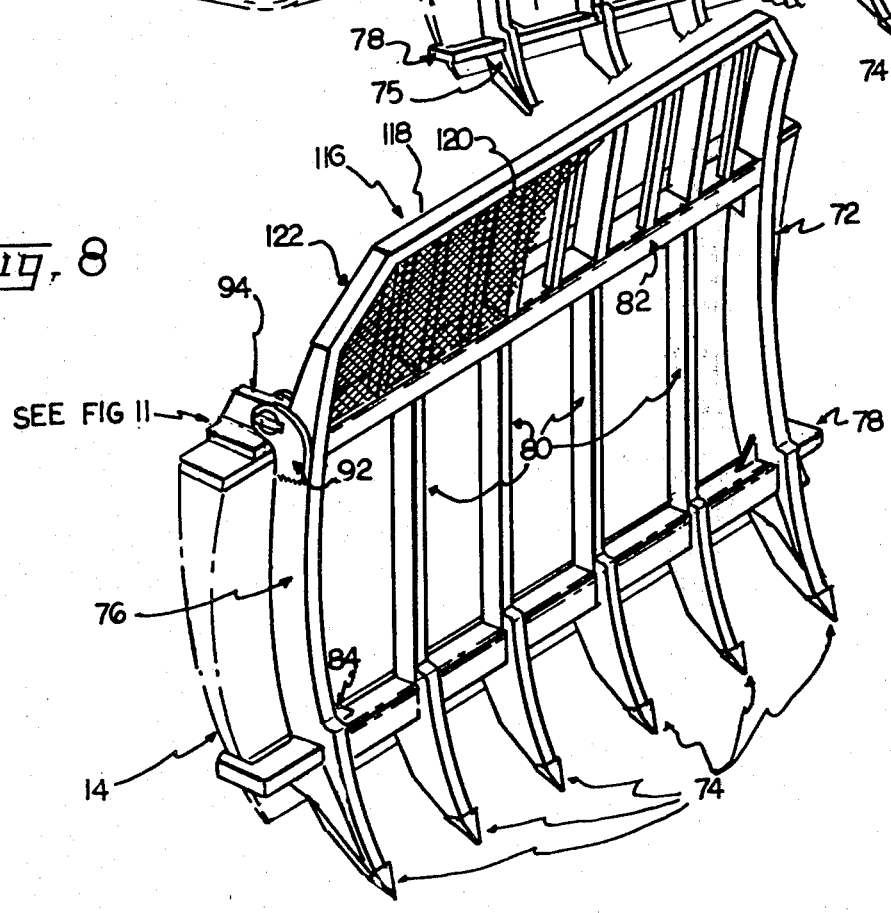
FIG. 8 is an isometric view of the assembly of FIG. 7.

An alternate embodiment of the mounting system for pivotally securing an assembly to a blade is illustrated in FIGS. 7–11. As best illustrated in FIGS. 7 and 8, the assembly 70 includes a frame 72 having a plurality of teeth 74 projecting downwardly from its lower edge and braced with gussets 75. The frame 72 is formed by a pair of side members 76 projecting upwardly from where they are secured to a transverse member 78. The transverse member 78 may be rectangular in cross-section, as illustrated, or it may be tubular, particularly in the case of larger blades 12. Struts 80 extend upwardly from the transverse members 78 to a tubular member 82. Gussets 84 further strengthen the attachment between the vertical braces 80 and the transverse member 78. This structure is, as described so far, substantially identical to the embodiment of FIG. 1.

Figure 9:
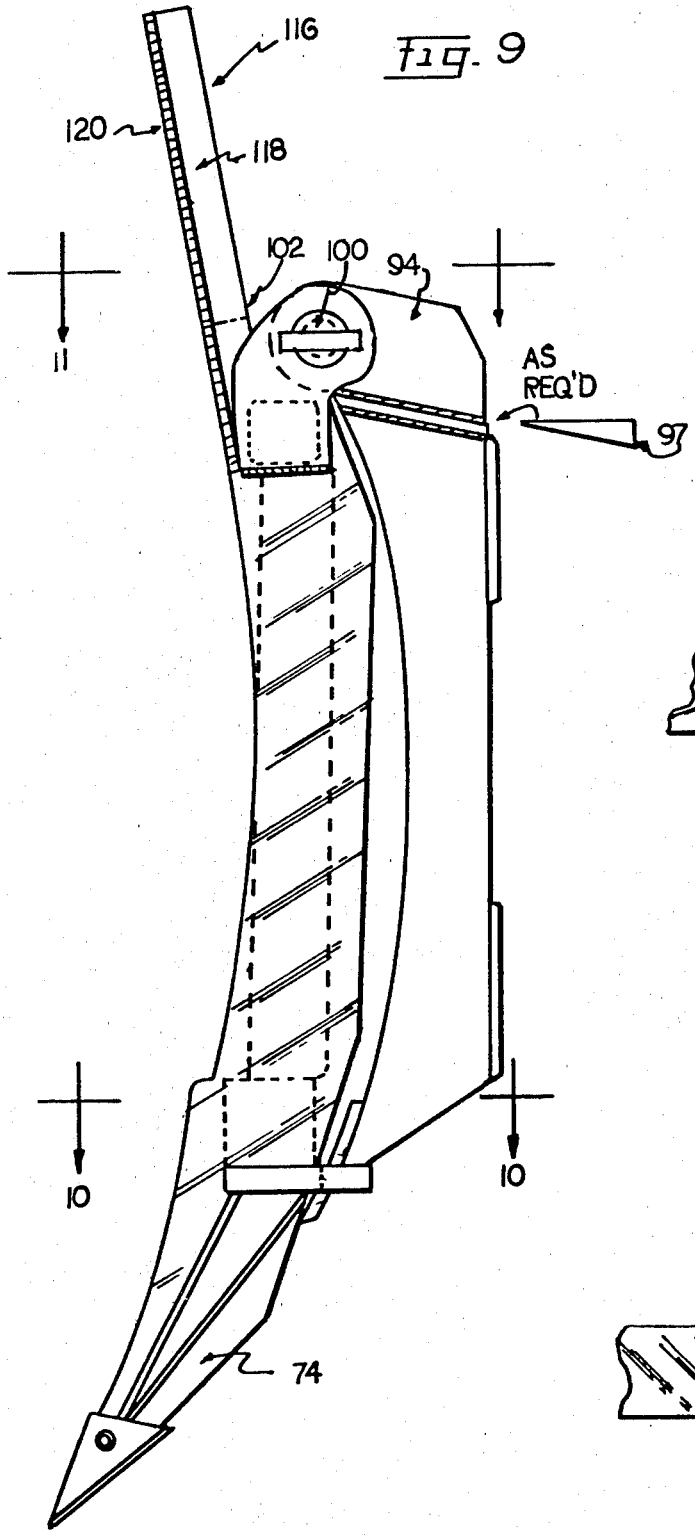
FIG. 9 is a side elevational view of the bulldozer teeth assembly of FIG. 8.
Figure 11:
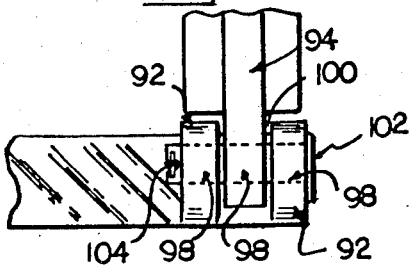
FIG. 11 is a cross-sectional view taken along the line 11—11 of FIG. 9, showing the structure for mounting the assembly on the bulldozer blade.

The upper ends of the side members 76 terminate in respective brackets 90 formed by a pair of ears or bracket members 92 mounted on opposite sides of the side members 76. As best illustrated in FIGS. 8 and 9, the bracket members 92 project upwardly and rearwardly from the side members 76. A forwardly projecting hanger 94 is secured to the upper surface of the bulldozer blade 12. The hanger 94 is welded to a base plate 95 which is, in turn, welded to a wedge-shaped shim 97. The angle of the shim 97 compensates for variations of the slant or angle at the top of various bulldozer blades 12. The shim 97 is preferably welded to the upper edge of the blade 12. As best illustrated in FIG. 11, the hanger 94 fits between the spaced bracket members 92, and a pin 100 having a relatively wide head 102 and removable cotter pin 104 to prevent axial movement of the pin 100 holds the hanger 94 in position by sliding through an aperture 98 in each bracket member 92. The fairly loose contact of the pin 100 with the bracket member 92 and hanger 94 allows the brackets to pivot freely with respect to the hanger 94.

Forces are exerted on the hanger 94 from a variety of directions. The principle forces are along the line of the major axis of the vehicle (substantially perpendicular to the commonly mounted blade). Since these forces act along the longitudinal axis of the hanger 94, the hanger 94 is able to withstand them. However, the hanger 94 also receives transverse forces to a lesser degree which pose a more serious problem since the ability of the hanger 94 to withstand bending responsive to transverse forces is markedly less than its ability to withstand longitudinal forces. The bending movement imparted to the hanger 94 is directly porportional to the distance that the hanger projects forwardly from the blade 12. Consequently, it is desirable to make the hanger as short as possible. Yet the hanger 94 must provide sufficient clearance between the side members 76 and the blade 12. In accordance with one aspect of the invention, the bracket members 92 project upwardly and rearwardly, as explained in reference to FIG. 9, to lessen the necessary projection distance of the hanger 94. As a result, the hanger's resistance to bending is markedly increased.

Figure 10:
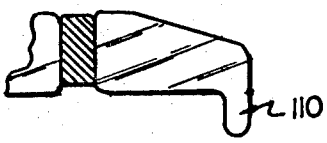
FIG. 10 is a cross-sectional view taken along the line 10—10 of FIG. 9, showing the manner in which the frame is adapted to wrap around the side of a bulldozer blade.

As with the embodiment of FIG. 1, rearwardly projecting side braces 110 extend along the sides of the blade 14 as illustrated in FIG. 10. These side braces 110 greatly increase the ability of frame 70 to withstand transverse loads.

Although the side members 76 may be formed separately from the teeth 74 at the sides of the frames 72, the side members 76 and teeth 74 at the ends of the frames 72 are preferably integrally formed with each other. This construction maximizes the strength of the frame 72.

Returning now to FIGS. 7, 8 and 9, a rigid rise extension 116 formed by a rectangular frame 118 covered by a rigid mesh 120 projects upwardly from the tubular member 82. The transverse dimension of the rise 116 is less than the distance between the hangers 94 so that the rise 116 does not interfere with the mounting structure. The side edges 122 of the rise 116 are beveled inwardly from the side of the blade 14 so that objects such as trees falling on the upper edge of the frame 118 near its sides are propelled from the rise 116. The rise 116 prevents objects from being propelled over the upper edge of the blade 14 where they may injure the vehicle operator.

Figure 12:
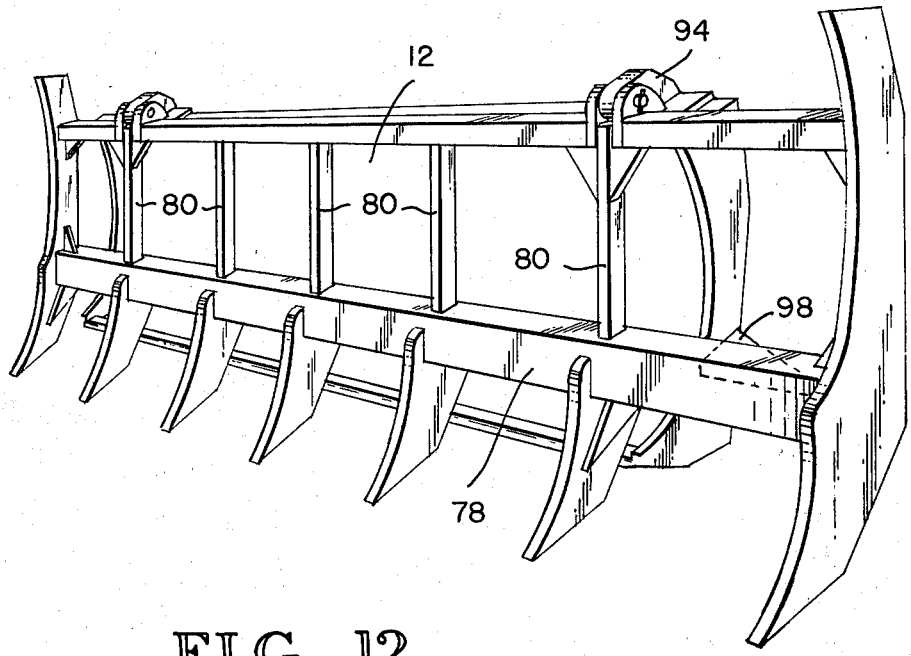
FIG. 12 is a perspective view of yet another embodiment of the assembly.

As best illustrated in FIG. 12, the assembly may project outwardly from the sides of the blade 12 to form a wide-mounted rake on a standard-width blade. The hangers 94 are positioned directly above a strut 80 to provide structural stability to longitudinal forces on the assembly. Transverse stresses are reduced with triangular gussets of plate metal welded to the transverse member 78 to slide against the outer edges of the blade 12. Preferably, the wide-mounted rake has the hangers 94 on the first inward strut 80.

I claim:

1. In an assembly adapted to be pivotally secured to a blade on heavy equipment, such as a bulldozer, in either a deployed or undeployed position, and including a rigid rectangular frame having (i) a plurality of teeth projecting from one transverse edge and (ii) mounting means for pivotally securing the frame to the blade, the improvement comprising:

a tubular mounting sleeve secured to the edge of the frame opposite the teeth and a pair of forwardly projecting hangers fastened to the upper edge of the blade at opposite sides thereof, each hanger being releasably received by ears which are secured to the upper edge of the blade and receiving a pin projecting from opposite ends of the mounting sleeve so that the frame may be pivoted between the deployed position in which the frame lies along the front face of the blade and the undeployed position in which the frame projects upwardly above the upper edge of the blade.

2. In an assembly adapted to be pivotally secured to a blade on heavy equipment, such as a bulldozer, in either a deployed or undeployed position, and including a rigid rectangular frame having (i) a plurality of teeth projecting from one transverse edge and (ii) mounting means for pivotally securing the frame to the blade, the improvement comprising:

a tubular mounting sleeve secured to the edge of the frame opposite the teeth and a pair of forwardly projecting hangers fastened to the upper edge of the blade at opposite sides thereof, each hanger receiving a pin projecting from opposite ends of the mounting sleeve so that the frame may be pivoted between the deployed position in which the frame lies along the front face of the blade and the undeployed position in which the frame projects upwardly above the upper edge of the blade, said pins being slidably received in the hangers and the inwardly projecting end of each pin having a circumferential groove for receiving a set screw threaded in a bore through the mounting sleeve so that set screws contact the pins within the grooves to secure the pins to the sleeves while allowing the pins to rotate in the hangers.

3. In an assembly adapted to be pivotally secured to a blade on heavy equipment, such as a bulldozer, in either a deployed or undeployed position, and including a rigid rectangular frame having (i) a plurality of teeth projecting from one transverse edge and (ii) mounting means for pivotally securing the frame to the blade, the improvement comprising:

a tubular mounting sleeve secured to the edge of the frame opposite the teeth and a pair of forwardly projecting hangers fastened to the upper edge of the blade at opposite sides thereof, each hanger receiving a pin projecting from opposite ends of the mounting sleeve so that the frame may be pivoted between the deployed position in which the frame lies along the front face of the blade and the undeployed position in which the frame projects upwardly above the upper edge of the blade, said assembly extending outwardly from sides of the blade and the frame having gussets to reduce transverse stresses on the hangers by positioning the frame against the sides of the blade.

4. In an assembly adapted to be pivotally secured to a blade on heavy equipment, such as a bulldozer, and including (i) a rigid rectangular frame having a pair of rigid, elongated side members and a plurality of teeth projecting downwardly from a lower edge of the frame, and (ii) mounting means for pivotally securing the frame to the blade, the improvement comprising:

an ear secured to the upper end of each side member to curve upwardly and rearwardly toward the blade; and a pair of spaced hangers projecting forwardly from the upper edge of the blade and capable of being pivotally secured to the ears, whereby the rearward curvature of the ears minimizes the necessary projection distance of the hanger, thereby minimizing the moment arm of the hangers with respect to transverse forces applied to the assembly.

5. The assembly as defined in claim 4 wherein each ear includes a pair of spaced, upwardly and rearwardly projecting bracket members having axially aligned apertures, and wherein each hanger projects between the bracket members and has an aperture positionable in axial alignment with the apertures of the bracket members, and the assembly further includes a cylindrical pin for each hanger releasably insertable through the apertures to secure the frame to the blade, but to allow pivoting of the assembly with respect to the blade.

6. The assembly of claim 4, further including a rigid rise extension panel projecting upwardly from the upper edge of the blade between the hangers to prevent objects from being propelled over the upper edge of the blade.

7. The assembly of claim 6 wherein the side edges of the rise extension panel are beveled inwardly toward its upper edge to deflect objects falling on the rise extension panel transversely away from the rise extension panel.

8. The assembly of claim 4 wherein the side members project downwardly to form end teeth at the lower edge of the frame so that the end teeth and end members form a unitary structure to maximize the strength of the frame and teeth.

* * * * *